US006457226B1

(12) United States Patent
Krehle

(10) Patent No.: US 6,457,226 B1
(45) Date of Patent: Oct. 1, 2002

(54) PROCESS FOR BEADING SHEET METAL PARTS IN A BEADING MACHINE

(76) Inventor: Guido-Michael Krehle, Graf-Zeppelin-Strasse 15a, Landsberg am Lech (DE), D-86899

( * ) Notice: Subject to any disclaimer, the term of this patent is extended or adjusted under 35 U.S.C. 154(b) by 0 days.

(21) Appl. No.: 09/589,045

(22) Filed: Jun. 6, 2000

(51) Int. Cl.[7] ..... B21D 39/02
(52) U.S. Cl. ..... 29/509; 29/243.58; 72/181
(58) Field of Search ..... 72/181, 182, 179; 29/509, 243.58

(56) References Cited

U.S. PATENT DOCUMENTS

| | | | | | |
|---|---|---|---|---|---|
| 2,283,258 | A | * | 5/1942 | Jensen | 72/181 |
| 2,588,120 | A | * | 3/1952 | Ingels | 72/181 |
| 2,682,850 | A | * | 7/1954 | Close | 72/178 |
| 2,825,384 | A | * | 3/1958 | Goldsmith | 29/505 |
| 3,191,283 | A | * | 6/1965 | Cain | 72/182 |
| 3,475,937 | A | * | 11/1969 | Lawler | 72/181 |
| 3,528,167 | A | | 9/1970 | Lipp | |
| 3,754,424 | A | | 8/1973 | Costanzo | 72/121 |
| 3,838,498 | A | | 10/1974 | Lipp | 29/509 |
| 3,931,725 | A | * | 1/1976 | Yon | 72/181 |

* cited by examiner

*Primary Examiner*—Daniel C. Crane
(74) *Attorney, Agent, or Firm*—Michael A. Mann; Nexsen Pruet Jacobs & Pollard

(57) ABSTRACT

The present invention relates to a beading machine for shaping, edge-forming and beading sheet metal parts, with at least two corresponding beading rollers 12, 14, wherein each beading roller pair includes an upper beading roller 12 and a lower beading roller 14 as well as at least one limit stop for the sheet metal parts to be processed. In this case, the limit stop 16 for the sheet metal elements is provided in either or both of said beading rollers. The invention simultaneously relates to a process for shaping, edge forming and beading sheet metal parts by means of a beading machine of the present invention.

2 Claims, 3 Drawing Sheets

PROCESS FOR BEADING SHEET METAL PARTS IN A BEADING MACHINE

BACKGROUND OF THE INVENTION

The present invention relates to a beading machine for shaping, edge-forming and beading sheet metal parts, which machine comprises at least two corresponding beading rollers, each such beading roller pair including an upper beading roller and a lower beading roller as well as at least one limit stop for the sheet metal parts to be processed. The invention further relates to a process for shaping, edge forming and beading sheet metal parts by means of a beading machine.

1. Discussion of the Prior Art

Beading machines of this type and processes for beading sheet metal parts are known from the prior art. These types of beading machines and processes are especially used for cold forming sheet metal parts. In this case, the forming step comprises inserting the sheet metal part to be processed into a gap formed by the beading roller pair and making it pass there through. A shortcoming of the prior art beading machines and corresponding processes, however, is that fixed stops are always used for this purpose. However, fixed stops limit the application range of prior art beading machines and processes to the forming of defined radii or straight edges only. Consequently, prior art beading machines and processes will not be able to generate shapes, which include varying radii.

2. Object of the Invention

Therefore, it is the object of the present invention to provide a generic beading machine, which allows straight shapes, shapes with fixed radii as well as shapes with changing, variable radii to be created in a sheet metal part.

It is a further object of the present invention to provide a generic process, which allows straight shapes, shapes with fixed radii as well as shapes with changing, variable radii to be obtained in a sheet metal part.

This object is accomplished by the features of the independent claims.

Further embodiments of the invention are described in the subclaims.

A beading machine of the present invention will not require the presence of fixed limit stops for guiding the one or plural sheet metal part(s). In accordance with the invention, the limit stop for the sheet metal parts is provided in either or both beading roller(s). In the present invention, the beading roller takes the function of the known fixed limit stop. This will allow the generation of shapes with changing radii. However, it will also allow the generation of both straight shapes, and shapes with fixed radii. Additional separate limit stops, which are included in prior art beading machines, will no longer be required.

DESCRIPTION OF THE PREFERRED EMBODIMENTS

In an advantageous embodiment of the beading machine of the invention, the upper and lower beading rollers together form a feed gap for the sheet metal parts, which feed gap changes into a folded recess that includes at least one pressing and bending surface, and an edge bender is provided in a beading roller, between the feed gap and the folded recess, and the limit stop is located opposite said edge bender, in the respective other beading roller. A beading machine design of this kind eliminates the need for separate limit stops for the sheet metal parts—which makes the beading machine of the present invention more versatile regarding its range of applications.

In yet another advantageous embodiment of the beading machine of the invention, the folded recess extends towards the exterior, in the direction opposite the feed gap, and becomes a free gap funnelling open towards the exterior. This allows sheet metal parts of varying thickness to be processed without any problems, even in the case of relatively thick sheet metal parts, since the free gap will prevent any contact between the upper and lower beading rollers.

In accordance with the desired working mode for the sheet metal parts, a beading machine of the present invention can have the limit stop in the lower beading roller, extending along the feed gap up to the pressing and bending surface. On the other hand, it is likewise possible to provide the limit stop in the upper beading roller, in the transition from the feed gap to the pressing and bending surface. In yet another advantageous embodiment of the invention, the limit stop is likewise provided in the upper beading roller, extending along the feed gap up to the pressing and bending surface.

An inventive process for shaping, edge-forming and beading sheet metal parts by means of a beading machine comprises the following steps:

In a first procedural step a), a first sheet metal part is introduced into a beading machine with a beading roller pair including upper and lower beading rollers, with a limit stop being provided in the lower beading roller and extending along the feed gap up to the pressing and bending surface, and made to pass there through so as to perform a first forming operation on said first sheet metal part. In a further procedural step b), said first sheet metal part is introduced into a beading machine with a beading roller pair including upper and lower beading rollers, with a limit stop being formed in the upper beading roller and being located in the transition from the feed gap to the pressing and bending surface, and made to pass there through so as to perform a second forming operation on said first sheet metal part. Subsequently, in a further procedural step c), a second sheet metal part is introduced into said beading machine with said beading roller pair including said upper and lower beading rollers, with a limit stop being provided in said lower beading roller and extending along the feed gap up to the pressing and bending surface, and made to pass there through so as to perform a first forming operation on said second sheet metal part. Finally, both first and second sheet metal parts are joined together at the deformed ends, and the joined sheet metal parts are then introduced into a beading machine with a beading roller pair including upper and lower beading rollers, with a limit stop being provided in the upper beading roller and extending along the feed gap up to the pressing and bending surface, and made to pass there through so as to obtain a close and non-detachable connection of the first and second sheet metal parts. The process of the present invention allows the shaping of sheet metal parts including changing radii. However, straight shapes and shapes with fixed radii are likewise possible.

In yet another advantageous embodiment of the process of the invention, the process is performed continuously by mounting the different pairs of beading rollers in series.

A beading machine of the invention may e.g. be used for manufacturing dormers, bent grooves or bent wall covers of varying radii from sheet metal parts.

BRIEF DESCRIPTION OF THE DRAWINGS

Further details, features and advantages of the invention may be gathered from the description, which follows of the embodiments illustrated in the drawings, of which

FIG. 1 is the schematically view of a beading machine 10 with an upper beading roller 12 and a lower beading roller 14. Taken together, the upper and lower beading rollers 12, 14 form a feed gap 32 for inserting sheet metal parts to be processed therein and making them pass there through. This view shows that a limit stop 16 for the sheet metal parts is formed in the lower beading roller 14, extending along the feed gap up to a pressing and bending surface 24.

Figure 1:
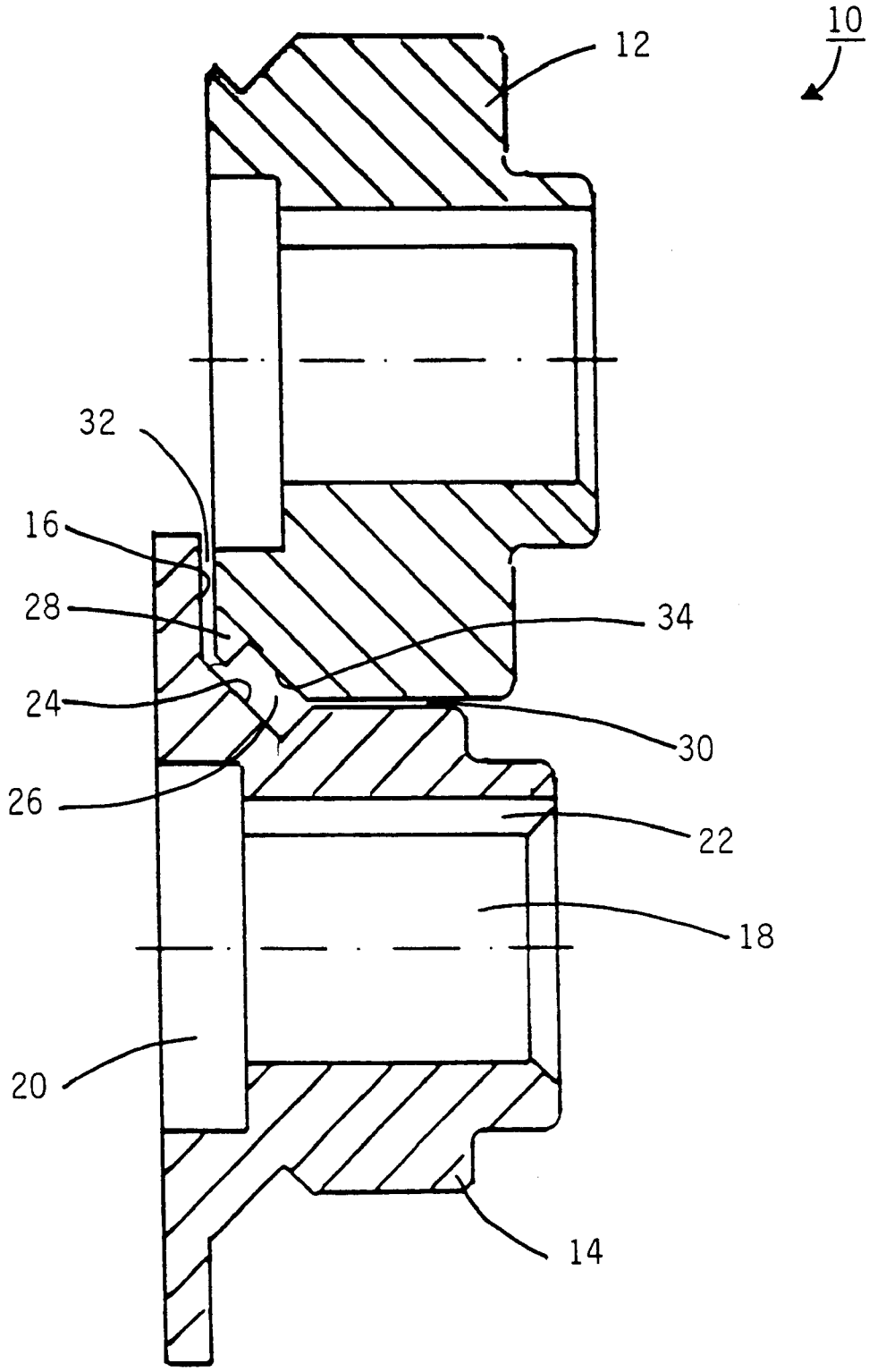
FIG. 1 is a schematically view of a first beading roller pair of a beading machine in accordance with the present invention.

The view of FIG. 1 further shows that the feed gap 32 changes into a folded recess 26, which includes two pressing and bending surfaces 24, 34. Provided in the upper beading roller 12, between said feed gap 32 and said folded recess 26, is an edge bender 28. It can be seen from this view that the limit stop 16 is provided in the lower beading roller 14, opposite said edge bender 28. The folded recess 26 extends toward the exterior, in the direction opposite said feed gap 32, and becomes a free gap 30 funnelling open towards the exterior. Both beading rollers 12, 14 are rotably mounted in fastening means, with a groove 20 for a knurled nut (not shown), a fit 18 and a groove 22 for an attachment wedge (not shown) to be inserted all being provided for mounting the fastening or attachment means. The beading rollers 12, 14 are usually made of hardened steel. However, it is also possible to use other materials of similar hardness characteristics.

Figure 2:
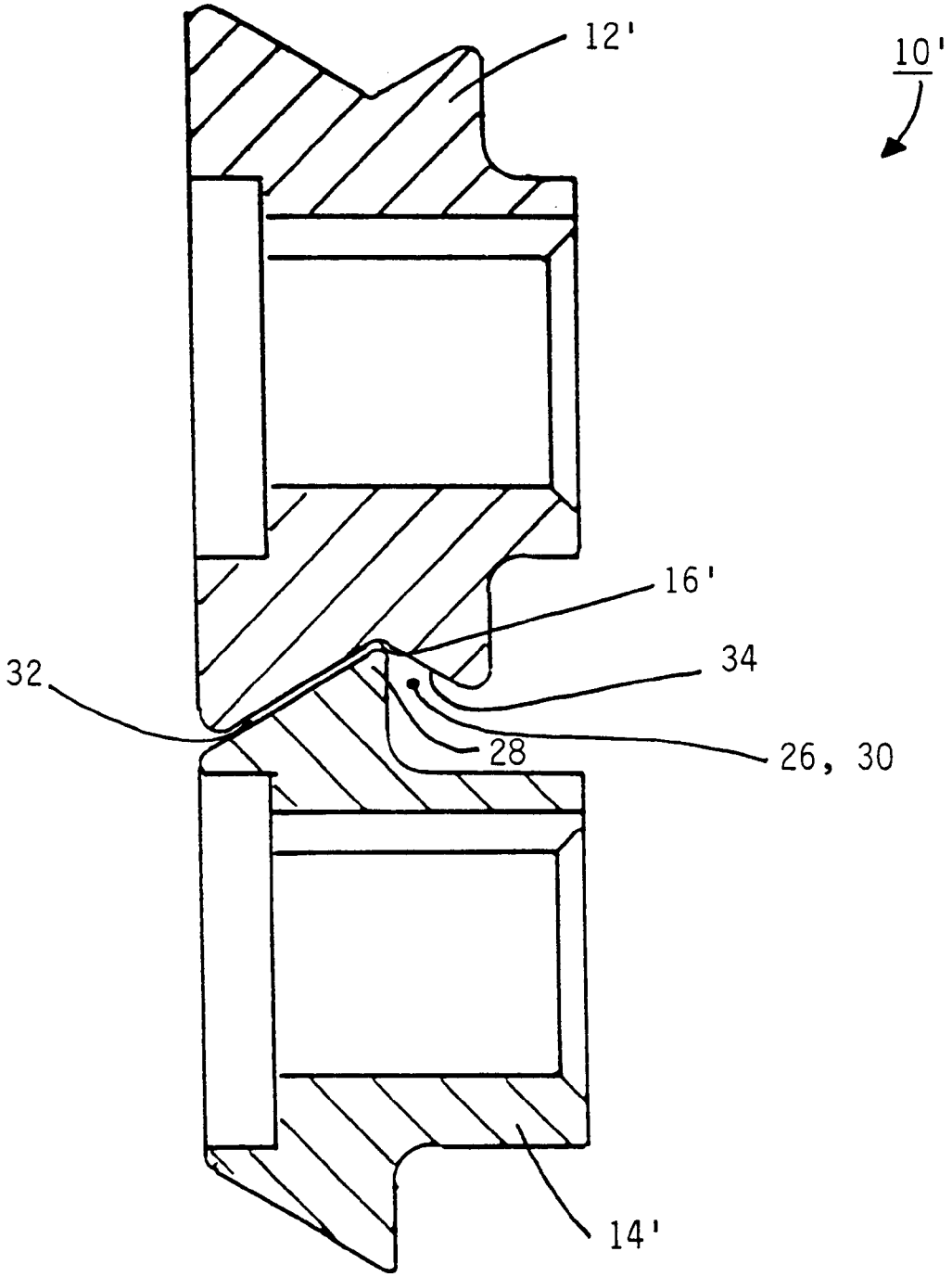
FIG. 2 is a schematically view of another beading roller pair of a beading machine in accordance with the present invention.

FIG. 2 is a schematically view of a beading machine 10' with an upper beading roller 12' and a lower beading roller 14'. As can be gathered from this view, the feed gap 32 is likewise formed between the two beading rollers 12' and 14'. The feed gap here likewise changes into the folded recess 26 and the free gap 30. In the illustrated embodiment, a limit stop 16' is provided in the upper beading roller 12' and formed in the transition from the feed gap 32 to the pressing and bending surface 34. Opposite said limit stop 16', the edge bender 28 is again located. Further features of the beading machine 10' of FIG. 2 are identical to those of the embodiment of the beading machine of FIG. 1.

Figure 3:
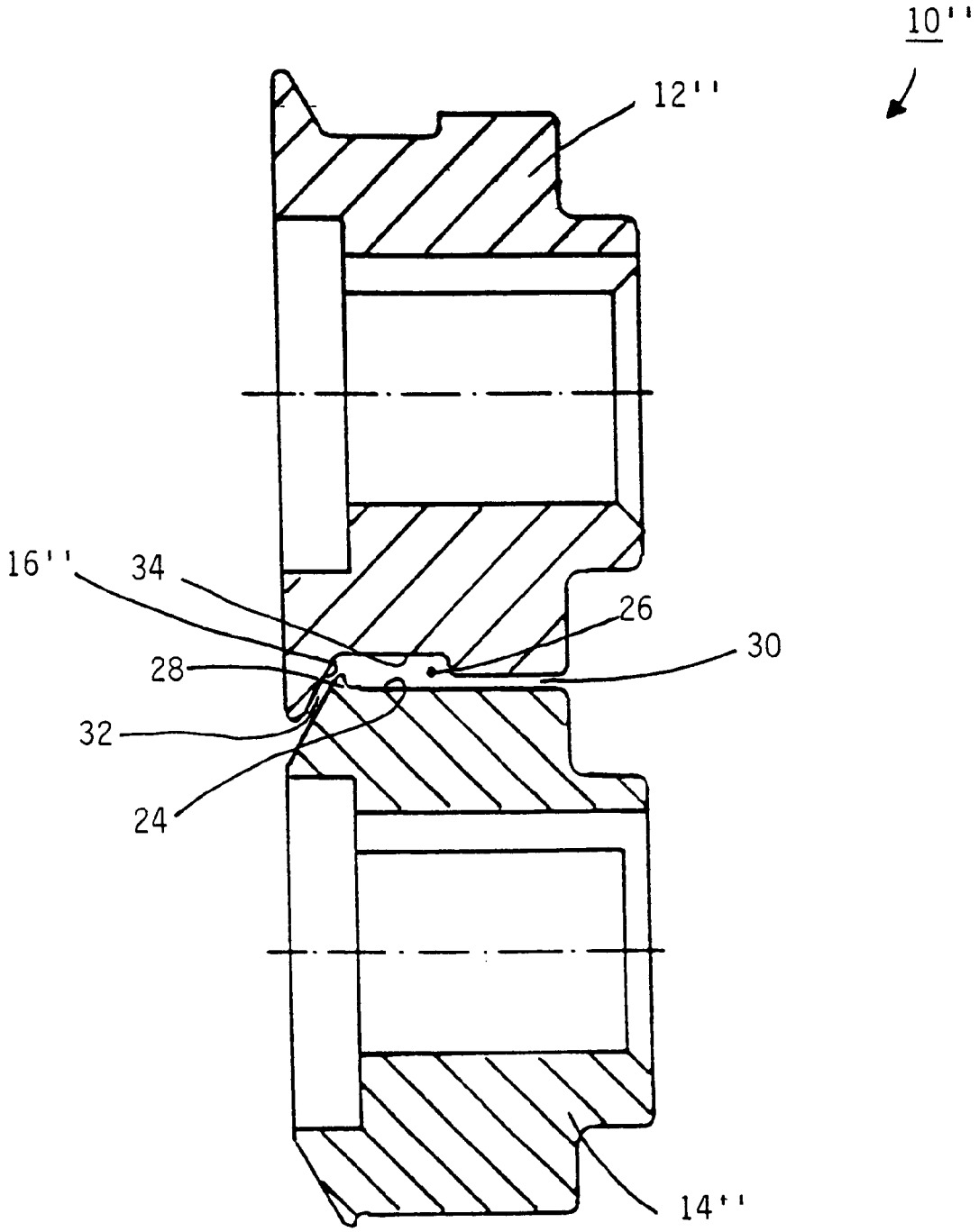
FIG. 3 is a schematically view of a further beading roller pair of a beading machine in accordance with the present invention.

FIG. 3 is a schematically view of a beading machine 10" with an upper beading roller 12" and a lower beading roller 14". This beading roller pair, too, forms a feed gap 32, which ultimately becomes a folded recess 26 and a free gap 30. In this embodiment, a limit stop 16" is provided in the upper beading roller 12" and extends along the feed gap 32 up to the pressing and bending surface 34. The edge bender 28 is located opposite said limit stop 16". The beading machine 10" with the beading roller pair 12", 14" is used for connecting a first and a second sheet metal part in a close and non-detachable manner.

DETAILED DESCRIPTION

The following is an exemplary description of how a bent groove of varying radii is manufactured from two sheet metal parts. First of all, a first sheet metal part whose one end has already been turned on edge is inserted into the beading machine 10 with the beading roller pair 12, 14 and made to pass there through. This causes a further turning on edge, and the resulting fold closes. Subsequently, the thus formed end of the sheet metal part is inserted into the beading machine 10' with the beading roller pair 12', 14' and made to pass there through. This causes further turning on edge of the end of the first sheet metal part. Finally, a second sheet metal part is inserted into the beading machine 10 with the beading roller pair 12, 14 and made to pass there through so as to likewise generate a turning on edge and a closed fold at one end of the second sheet metal part. The thus formed ends of the first and second sheet metal parts are slid together, inserted into the beading machine 10" with the beading roller pair 12", 14" and made to pass there through. This connects the two sheet metal parts in a close and non-detachable manner.

Besides the manufacture of bent grooves from sheet metal parts, wall covers can also be produced in a simple and inexpensive manner. However, any other element, which comprises bent sheet metal parts of possibly varying radii, can be produced by means of the beading machines 10, 10', 10".

What is claimed is:

1. A process for shaping, edge-forming and beading sheet metal parts by means of a beading machine, wherein said process comprises the following steps:

a. inserting a first end of a first sheet metal part into a first beading machine (10) with a first beading roller pair including upper and lower beading rollers (12,14) and making it pass there through, with a limit stop (16) being provided in said lower beading roller (14) and extending along said feed gap (32) up to a pressing and bending surface (24), and with a first forming operation being performed on said first end of said first sheet metal part;

b. inserting said first end of said sheet metal part into a second beading machine (10') with a beading roller pair including upper and lower beading rollers (12', 14') and making it pass there through, with a limit stop (16') being provided in said upper beading roller (12') and being located in the transition from said feed gap (32) to said pressing and bending surface (24), and with a second forming operation being performed on said first end of said first sheet metal part;

c. inserting a first end of a second sheet metal part into said first beading machine (10) with said beading roller pair including upper and lower beading rollers (12, 14) and making it pass there through, with a limit stop (16) being provided in said lower beading roller (14) and extending along said feed gap (32) up to said pressing and bending surface (24), and with a first forming operation being performed on said first end of said second sheet metal part;

d. joining said first ends of said first and second sheet metal parts together and placing said joined sheet metal parts into a third beading machine (10") with a beading roller pair including upper and lower beading rollers (12", 14") and making them pass there through, with a limit stop (16") being provided in said upper beading roller (12") and extending along said feed gap (32) up to said pressing and bending surface (24), whereby a close and non-detachable connection of said first and second sheet metal parts is obtained.

2. The process as claimed in claim 1 wherein said process is performed continuously by mounting the different pairs of beading rollers (12, 14), (12', 14'), (12", 14") in series.

* * * * *